US008791057B2

(12) United States Patent
Acher et al.

(10) Patent No.: US 8,791,057 B2
(45) Date of Patent: Jul. 29, 2014

(54) COMPOSITION

(75) Inventors: David Acher, Hull (GB); Vikki Louise Binns, Eyam (GB); Mark Ward, Hull (GB)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 151 days.

(21) Appl. No.: 13/056,431

(22) PCT Filed: Jun. 3, 2009

(86) PCT No.: PCT/GB2009/001387

§ 371 (c)(1), (2), (4) Date: May 20, 2011

(87) PCT Pub. No.: WO2010/012969

PCT Pub. Date: Feb. 4, 2010

(65) Prior Publication Data

US 2011/0212871 A1 Sep. 1, 2011

(30) Foreign Application Priority Data

Aug. 1, 2008 (GB) ..... 0814101.2

(51) Int. Cl.

| | |
|---|---|
| ***C11D 7/02*** | (2006.01) |
| ***C11D 7/08*** | (2006.01) |
| ***C11D 7/10*** | (2006.01) |

(52) U.S. Cl.

USPC ..... 510/238; 510/191; 510/245; 510/254; 510/269; 510/434; 510/477; 510/488; 510/507

(58) Field of Classification Search

USPC ..... 510/191, 238, 245, 254, 269, 434, 477, 510/488, 507

See application file for complete search history.

(56) References Cited

U.S. PATENT DOCUMENTS

| | | | | |
|---|---|---|---|---|
| 4,105,574 | A | 8/1978 | Culmone et al. | |
| 5,152,461 | A * | 10/1992 | Proctor | 239/304 |
| 6,583,103 | B1 * | 6/2003 | Klinkhammer | 510/478 |
| 2005/0282722 | A1 | 12/2005 | McReynolds et al. | |

FOREIGN PATENT DOCUMENTS

| | | | |
|---|---|---|---|
| EP | 1447461 | A | 8/2004 |
| GB | 1337977 | A | 11/1973 |
| GB | 2384244 | A | 7/2003 |
| WO | 9516023 | A | 6/1995 |
| WO | 0206437 | A1 | 1/2002 |
| WO | 2005068595 | A | 7/2005 |

* cited by examiner

*Primary Examiner* — Gregory R Delcotto

(74) *Attorney, Agent, or Firm* — Norris Mclaughlin & Marcus PA

(57) ABSTRACT

A multi-phase surface cleaning composition. A first phase comprises an acidic cleaning formulation. A second phase comprises an alkaline cleaning formulation. The second phase includes a synthetic clay component.

9 Claims, No Drawings

COMPOSITION

This is an application filed under 35 USC 371 of PCT/GB2009/001387.

The present invention relates to a surface cleaning composition.

In cleaning households surface cleaning such as bathroom/kitchen ware surfaces forms a large part of the cleaning requirement. It is important to keep these surfaces clean not only from an aesthetic viewpoint but also, more importantly, to reduce/prevent any build up of microbiological growth (particularly on stain deposits) which can give rise to unpleasant smells/potentially causes of infection.

Major causes of stain deposits on bathroom/kitchen ware arise from soap scum, a deposit of excess soap/soap residue from use in a personal cleaning operation; limescale, caused by a build up of metal salts (predominantly calcium and magnesium salts) from tap water; and grease, which is deposited on surfaces from manual contact or from cooking/food splashes.

In order to address soap scum and/or limescale, which are predominantly alkaline deposits, an acid cleaner is typically used. In order to address grease, an alkaline cleaner is typically used.

Thus there exists a problem when a consumer wishes to clean a surface which is stained with both grease and limescale/soap scum since an overly complex multi-step cleaning regime is required.

One simple way to address this problem is to apply both of the cleaning formulations simultaneously to the stain area. However, in this regard it has been found that the two cleaning formulations having quite different pHs typically mix forming an admixture having a largely neutral pH. This admixture of the two formulations has been found to be incapable of cleaning either the soap scum/limescale or the grease stain.

It is thus an object of the present invention to obviate/mediate some of the problems outlined above.

According to a first aspect of the invention there is provided a multi-phase surface cleaning composition, wherein a first phase comprises an acidic cleaning formulation and a second phase comprises an alkaline cleaning formulation, characterised in that the second phase includes a synthetic clay component.

The cleaning composition has been found to provide an excellent level of cleaning on hard surfaces. Without wishing to be bound by theory it is proposed that the high level of efficacy arises due to an effect induced by the presence of the synthetic clay in the alkaline phase of the composition. It is postulated that the clay aids the adhesion of the alkaline phase to the hard surface and additionally prevents mixing of the alkaline and acidic phase of the composition.

This has the beneficial effect that a stain requiring treatment with an acid formulation (e.g. soap scum/limescale) can be treated by the acidic phase, without the pH of the acidic phase being negatively effected by reaction with the alkaline phase. Similarly stains requiring treatment with an alkaline formulation (e.g. grease) can be treated by the alkaline phase, without any detrimental reduction of the pH of the alkaline phase. Moreover due to the enhanced adhesion of the alkaline phase with the hard surface stain treatment is improved as the exposure time of the stain to the alkaline cleaning composition is increased.

Preferably the alkaline phase comprises 0.01 to 25% of the synthetic clay, more preferably 0.01 to 5%, more preferably 0.5 to 3%, and most preferably about 2% of the synthetic clay. By using the term synthetic clay it is to be understood that the clay is produced artificially by chemical combination of the clay substituents.

It is preferred that the synthetic clay is a smectite or hectorite clay.

The synthetic clay is preferably laponite, which is available from, for example, Southern Clay Products.

Each phase of the composition may comprise one or more component typical of a cleaning formulation. In this regard each phase may separately contain one or more of surfactant (anionic, non-ionic, cationic and/or amphoteric), builder, bleach, bleach activator, bleach stabilizer, bleaching catalyst, enzyme, polymer, co-builder, alkalizing agent, acidifying agent, anti-redeposition agent, silver protectant, colourant, optical brightener, UV stabilizer, fabric softener, fragrance, soil repellent, anticrease substance, antibacterial substance, colour protectant, solvent, polish, discolouration inhibitor, vitamin, phyllosilicate, odour-complexing substance, rinse aid, foam inhibitor, foaming agent, preservative, or auxiliary.

Preferably the phases of the composition are aqueous.

For ease of application the composition is preferably packaged in an applicator, which is facile to use for a consumer.

Thus according to a second aspect of the invention there is provided a product comprising a multi-chamber container and a dispensing apparatus, wherein a first chamber of the container comprises a first composition comprising an acidic cleaning formulation and a second chamber of the container comprises a second composition comprising an alkaline cleaning formulation, characterised in that the second composition includes a synthetic clay component.

Ideally the product dispensing apparatus comprises a manually operated trigger spray. Preferably the trigger spray is such that a measure of the first and second chamber is delivered simultaneously to a target locus. To achieve this aim the trigger spray is preferably a dual trigger spray such as the trigger spray described in patent EP-A-0715899 of Calmar, the contents of which are incorporated by reference.

In a preferred mode of operation a user will apply one or more sprays of the composition onto a surface to be cleaned. Particularly for vertically orientated hard surfaces, the cleaning operation may require wiping or collection of the composition and removed stain material as it runs down under gravity. Indeed in such an event it is expected that the acidic phase of the composition will run down under gravity first, since the alkaline phase of the composition is expected to have a much greater level of adhesion on the surface being cleaned. In this regard it is anticipated that the cleaning operation may require agitation of the composition (particularly the alkaline composition) on the surface being cleaned. A final rinsing/wiping step may form a part of the cleaning process.

According to a third aspect of the invention there is provided the use of a multi-phase surface cleaning composition, wherein a first phase comprises an acidic cleaning formulation and a second phase comprises an alkaline cleaning formulation, characterised in that the second phase includes a synthetic clay component in cleaning a hard surface.

The invention will now be described with reference to the following non-limiting Examples.

EXAMPLE 1

The following hard surface cleaning compositions were prepared.

| Formula #1 | | Formula #2 | |
|---|---|---|---|
| Component | Wt % | Component | Wt % |
| Water | 87.75 | Water | 91.9 |
| Sulphamic acid | 5.0 | Laponite *** | 2.0 |
| Oxalic acid dihydrate | 2.0 | MEA(85%) | 0.002 |
| Formic acid(85%) | 3.0 | Alkyl Dimethyl Amine | 3.5 |
| Alkylethoxylate C9-11, 6EO | 0.5 | Propylene Glycol Phenyl Ether | 0.8 |
| Alkylethoxylate C10, 7EO | 1.3 | Dipropylene Glycol N-Butyl Ether | 0.5 |
| 1-Propoxypropanol-2 | 0.3 | Sodium Cumene sulphonate (40%) | 0.25 |
| Fragrance | 0.15 | Antifoam emulsion | 0.005 |
| Dye | 0.0005 | Fragrance | 0.15 |

*** A third formulation (formula 3) was prepared wherein the laponite was substituted for water.

Greasy tiles made were prepared according to the MTC-0092-01 methodology. Soap scum tiles were prepared according to the IKW Working Group method.

For the greasy tiles test, the tiles were sprayed with either just formula #3 or with both formula #1 and formula #2; or with both formula #1 and formula #3.

For the soap scum test, the tiles were sprayed with either just formula #1 or with both formula #1 and formula #2; or with both formula #1 and formula #3.

In all tests tiles were each sprayed with a spray device (with a dual spray device containing for tests involving two formulations) and cleaned with 14 runs in the abrasion tester (determined by number of runs needed to remove ~50% of soil).

Benchmark were separate products—same number of sprays.

The cleaned tiles were rated by a panel for % removal of soil.

Results

Grease Test

| Composition | Formula #3 | Formula #1 & Formula #3 | Formula #1 & Formula #2 |
|---|---|---|---|
| % Grease Removal | 52 | 24 | 46 |

Soap Scum Test

| Composition | Formula #1 | Formula #1 & Formula #3 | Formula #1 & Formula #2 |
|---|---|---|---|
| % Soap Scum Removal | 52 | 32 | 48 |

CONCLUSION

Testing has shown that using a twin formulation with an alkaline formulation thickened with 2% laponite and an acidic formulation that there is no significant difference in cleaning performance on soap scum tiles and parity performance on greasy tiles to separate cleaning formulations.

The invention claimed is:

1. A multi-phase hard surface cleaning composition, wherein a first phase comprises an acidic cleaning formulation and a second phase comprises an alkaline cleaning formulation, characterised in that the second phase comprises a laponite clay, and characterized in that after application onto a surface, the alkaline second phase of the composition exhibits a greater level of adhesion to the surface than the first phase of the composition, wherein said laponite clay prevents mixing of the alkaline second phase and the acidic first phase of the composition.

2. A composition according to claim 1, wherein the alkaline second phase comprises 0.01 to 25% of laponite clay.

3. A product comprising a multi-chamber container and a dispensing apparatus, containing the multi-phase surface cleaning composition according to claim 1, wherein a first chamber of the container comprises the first phase, and a second chamber comprises the second phase.

4. A product according to claim 3, wherein the dispensing apparatus is a manually operated trigger spray.

5. A composition according to claim 2, wherein the alkaline second phase comprises 0.01 to 5% of the laponite clay.

6. A composition according to claim 5, wherein the alkaline second phase comprises 0.5 to 3% of the laponite clay.

7. A composition according to claim 6, wherein the alkaline second phase comprises about 2% of the laponite clay.

8. A multi-phase cleaning composition according to claim 1, wherein the acidic cleaning formulation comprises one or more organic acids which are selected from the group consisting of sulphamic acid, oxalic acid, and formic acid.

9. A multi-phase cleaning composition according to claim 8, wherein the one or more organic acids necessarily include each of: sulphamic acid, oxalic acid, and formic acid.

* * * * *

UNITED STATES PATENT AND TRADEMARK OFFICE

CERTIFICATE OF CORRECTION

PATENT NO. : 8,791,057 B2
APPLICATION NO. : 13/056431
DATED : July 29, 2014
INVENTOR(S) : David Acher et al.

It is certified that error appears in the above-identified patent and that said Letters Patent is hereby corrected as shown below:

In the Specification:

Column 2, line 10: “laponite” should read --LAPONITE®, a registered trademark of BYK Additives Ltd.--

Column 3, line 11: in the table showing Formula #2: “Laponite” should read --LAPONITE®--

Column 3, line 20: in the caption “laponite” should read --LAPONITE®--

Column 4, line 13: “laponite” should read --LAPONITE®--

Signed and Sealed this
Fourteenth Day of April, 2015

Michelle K. Lee

Michelle K. Lee
*Director of the United States Patent and Trademark Office*